US005343719A

United States Patent [19]

Nakamori et al.

[11] Patent Number: 5,343,719

[45] Date of Patent: Sep. 6, 1994

[54] METHOD OF TRANSFERRING LOOPS INTEGRATED WITH A FLAT KNITTING MACHINE

[75] Inventors: Toshinori Nakamori; Minoru Sonomura, both of Wakayama, Japan

[73] Assignee: Shima Seiki Mfg., Ltd., Wakayama, Japan

[21] Appl. No.: 956,133

[22] Filed: Oct. 2, 1992

[30] Foreign Application Priority Data

Oct. 4, 1991 [JP] Japan ..... 3-257830

[51] Int. Cl.[5] ..... D04B 7/00; D04B 15/66

[52] U.S. Cl. ..... 66/75.1; 66/78

[58] Field of Search ..... 66/71, 74, 75.1, 76, 66/77, 78, 70, 54, 95, 96 R, 123

[56] References Cited

U.S. PATENT DOCUMENTS

| | | | |
|---|---|---|---|
| 4,545,219 | 10/1985 | Schmodde | 66/70 |
| 4,559,791 | 12/1985 | Schimko et al. | 66/75.1 |
| 4,637,228 | 1/1987 | Shima | 66/75.1 |
| 4,643,003 | 2/1987 | Schmodde | 66/78 |
| 4,729,230 | 3/1988 | Schmodde et al. | 66/78 |

*Primary Examiner*—Clifford D. Crowder
*Assistant Examiner*—Larry D. Worrell, Jr.
*Attorney, Agent, or Firm*—Edwin E. Greigg; Ronald E. Greigg

[57] ABSTRACT

The invention hereby provides a novel flat knitting machine which is furnished with a pair of needle beds in the front and rear positions each having a plurality of knitting needles aligned in parallel in such a condition in which respective knitting needles face each other, where a loop expanding member is provided on a lateral surface of each knitting needle. When transferring a loop from a delivery-side knitting needle engaged with this loop to an opposite receiving-side knitting needle, the receiving-side knitting needle is carried forward before the loop engaged with the delivery-side knitting needle is expandably opened by the loop expanding member, and then, the receiving-side knitting needle receives the loop in order that the loop engaged with the delivery-side knitting needle can properly be transferred to the loop expanding member from a hook of the delivery-side knitting needle. Next, the loop expanding member expandably opens the loop engaged with the delivery-side knitting needle. Next, the hook at the tip end of the delivery-side knitting needle penetrates a clearance between the loop expanding member and a lateral surface of the delivery-side knitting needle to engage the expanded loop with the hook. When transferring loops, the apparatus securely guides stitch/loop to the delivery position without incurring load to the stitch while closing the hook of the delivery-side knitting needle or by way of retracting the delivery-side knitting needle on the way of closing the hook.

2 Claims, 7 Drawing Sheets

METHOD OF TRANSFERRING LOOPS INTEGRATED WITH A FLAT KNITTING MACHINE

BACKGROUND OF THE INVENTION

The present invention relates to a method of transferring loops using a flat knitting machine and to an apparatus for transferring the loops.

Normally, in order to expandably open a loop of a delivery-side knitting needle and to surely hook the loop with a hook of a receiving-side knitting needle, a loop expanding member is provided for any conventional knitting needle of a flat knitting machine incorporating a loop transfer function. The loop expanding member is attached to a lateral surface of the delivery-side knitting needle. The loop expanding member called "wing", enables a receiving-side knitting needle to penetrate into a clearance between a delivery-side knitting needle and said clearance (in transferring) in order that the loop of the delivery-side knitting needle can smoothly be transferred to the receiving-side knitting needle.

Generally, knitting needles provided for a flat knitting machine are classified into two kinds including the following: A "latch" needle having an end being swingably held by an aperture of a hook at the top end of each knitting needle. The aperture of this hook is opened and closed by means of a brush or knitting yarn that passes through the latch needle. The other one is called a "compound" needle whose aperture is opened and closed by means of a slider which is operated by a cam provided for a carriage unit.

While a carriage moves to the left in a flat knitting machine furnished with a number of latch needles, loci of the delivery-side knitting needles and receiving-side knitting needles in the course of transferring stitches from those knitting needles of the rear-side needle bed to those knitting needles of the front-side needle bed are typically illustrated in FIG. 1. On the other hand, FIG. 2 illustrates loci of the delivery-side knitting needles and the receiving-side knitting needles of a flat knitting machine furnished with compound needles.

Nevertheless, on the way of transferring stitches with a flat knitting machine furnished with latch needles, stitches held with those delivery-side knitting needles are apt to be slidably moved along the delivery-side knitting needles accompanying the forward movement of these knitting needles. In consequence, loops may not be properly guided to the predetermined delivery position of those delivery side knitting needles.

If loops were not properly guided, then loops cannot correctly be engaged with hooks of corresponding receiving-side knitting needles. If these loops were cleared from those delivery-side knitting needles, then all stitches will be constricted. To prevent this, those ascended delivery-side knitting needles are retracted in order to release tension between those knitting needles and stitches, and then, those delivery-side knitting needles are again set to the stitch delivery position before permitting those receiving-side knitting needles to move on themselves until reaching the loop receiving position so that loops can eventually be transferred to these receiving-side knitting needles.

In this case, those receiving-side and delivery-side knitting needles respectively start to intersect with each other at position X shown in FIG. 1. Therefore, the above cited conventional flat knitting machine needs to provide each delivery-side knitting needle with such a cam mount for releasing tension between the delivery-side knitting needle and stitch and another cam mount for again guiding those delivery-side knitting needles to the loop transferring position, thus requiring provision of a lock having an expanded width. In other words, the flat knitting machine needs to install a large-dimensional carriage.

Furthermore, since loops are forcibly lifted while knitting needles move forward, an unwanted load is applied to stitches to cause the knitting yarn to easily be cut off. In consequence, when composing a knit with those knitting yarns containing poor elasticity or by closely putting stitches together, independent of the forward and backward movements of knitting needles, any conventional flat knitting machine cannot securely prevent loops from being lifted forcibly.

The Japanese Patent Publication No. 1-37495 of 1989 proposes such a flat knitting machine furnished with compound needles. Nevertheless, as is clear from loci shown in FIG. 2, the installed lock is not provided with a pair of cam mounts essential for materializing those loci X1 and X2 shown in FIG. 1, which are necessary for the system to fully prevent loops from forcibly being lifted. In consequence, like the flat knitting machine furnished with latch needles cited above, loops engaged with those delivery-side knitting needles may also be lifted relative to the forward movement of the delivery-side knitting needles, thus preventing loops from properly being transferred to the receiving-side knitting needles.

Therefore, the invention has been achieved to fully solve those technical problems inherent in any of those conventional flat knitting machines. An object of the invention is to provide a novel method of and a novel apparatus for securely guiding stitches to the predetermined transferring position without incurring load to stitches on the way of a transfer operation. Characteristically, the novel method embodied by the invention enables anyone concerned to easily design and manufacture compact carriages.

SUMMARY OF THE INVENTION

The invention hereby provides a novel method of transferring loops by operating a novel flat knitting machine comprising a pair of needle beds in the front and rear positions each having a plurality of knitting needles aligned in parallel, and in addition, a loop expanding member is provided on a lateral surface of each delivery-side knitting needle. When transferring loops from respective delivery-side knitting needles engaged with loops to the opposite loop receiving knitting needles, before operating each loop expanding member to expandably open loops respectively being engaged with those delivery-side knitting needles, all the corresponding receiving-side knitting needles are once carried forward to a position close to each loop expanding member in such a condition in which respective hooks of those delivery-side knitting needles do not interfere with those loop expanding members. Next, the receiving-side knitting needles respectively receive loops in order that loops of those delivery-side knitting needles can be transferred from hooks of those delivery-side knitting needles to respective loop expanding members. Next, loops expandably opened by those loop expanding members are engaged with hooks at the top end of each receiving-side knitting needle after penetrating each hook through a clearance between each loop expanding member and lateral surface of each needle. Finally, loops of those delivery-side knitting needles are transferred to the corresponding receiving-side knitting needles by retracting those delivery-side knitting needles by way of closing or retracting hooks of those delivery-side knitting needles on the way of closing these knitting needles.

In addition, the invention also provides a novel apparatus for correctly transferring loops engaged with respective delivery-side knitting to those corresponding receiving-side knitting needles for use with a novel flat knitting machine related to the invention, where the integrated loop transfer system comprises the following: A flat knitting machine related to the invention is provided with a pair of needle beds in the front and rear positions each having a plurality of knitting needles aligned in parallel. In addition, a loop expanding member is provided on a lateral surface of each knitting needle. When transferring each loop engaged with each of those delivery-side knitting needles to each of those corresponding receiving-side knitting needles, before operating each loop expanding member to expandably open each loop engaged with the delivery-side knitting needle, each of those receiving-side knitting needles is carried forward before receiving corresponding loops in order that each loop can be transferred from each hook of the delivery-side knitting needle to the corresponding loop expanding member. Next, those receiving-side knitting needles are retracted from the position at which each loop expanding member and each hook at the top end of the receiving-side knitting needle interfere with each other so that unwanted interference between these components can be prevented from occurring. Next, those delivery-side knitting needles are again carried forward to permit those hooks at the top ends of those delivery-side knitting needles to penetrate a clearance between each loop expanding member and a lateral surface of each knitting needle so that those hooks can be engaged with corresponding loops expandably opened by each loop expanding member. Finally, each loop engaged with each delivery-side knitting needle is smoothly transferred to the corresponding receiving-side knitting needle by closing or retracting the hooks of respective delivery-side knitting needles in the course of closing these hooks.

In addition, the invention also provides such a novel apparatus for transferring loops from respective delivery-side knitting needles to those corresponding receiving-side knitting needles for use with a novel flat knitting machine. The novel flat knitting machine is provided with a pair of needle ends in the front and rear positions each having a plurality of knitting needles aligned in parallel with each other so that these knitting needles can be moved back and forth by means of a carriage. The carriage itself incorporates a cam surface at a lateral position of a forward domain of a transfer-receiving cam of a transfer cam, where the cam surface carries forward each receiving-side knitting needle to a specific position for receiving a loop engaged with a delivery-side knitting needle before expandably opening loops engaged with those delivery-side knitting needles.

In addition, the invention also provides a novel apparatus for transferring loops from respective delivery-side knitting needles to corresponding receiving-side knitting needles for use with a novel flat knitting machine. In order to prevent each loop expanding member provided for each delivery-side knitting needle from interfering with hooks at the top end of those receiving-side knitting needles, a cam surface available for retracting each receiving-side knitting needle is provided on the rear lateral domain of a cam surface available for carrying forward each receiving-side needle.

Furthermore, the invention also provides a novel apparatus for transferring loops from those delivery-side knitting needles to corresponding receiving-side knitting needles for use with a novel flat knitting machine. Characteristically, inclined surfaces are provided for lateral surfaces of those delivery-side knitting needles interfering with hooks of respective receiving-side knitting needles (when laterally viewed) and/or tip portions of those hooks of receiving-side knitting needles interfering with each loop expanding member of respective delivery-side knitting needles.

DETAILED DESCRIPTION OF THE PREFERRED EMBODIMENTS

The First Embodiment

The first embodiment of the invention makes use of a novel flat knitting machine incorporating a pair of needle beds (not shown) which are disposed by way of "/\" shaped arrangement in the front and rear positions, where each of these needle beds is furnished with a number of knitting needles aligned in opposition from each other. All the knitting needles are movable in the forward and backward directions by means of a carriage 1. The carriage 1 and those knitting needles 2 are respectively of the structure shown in FIGS. 3 and 4.

Figure 1:
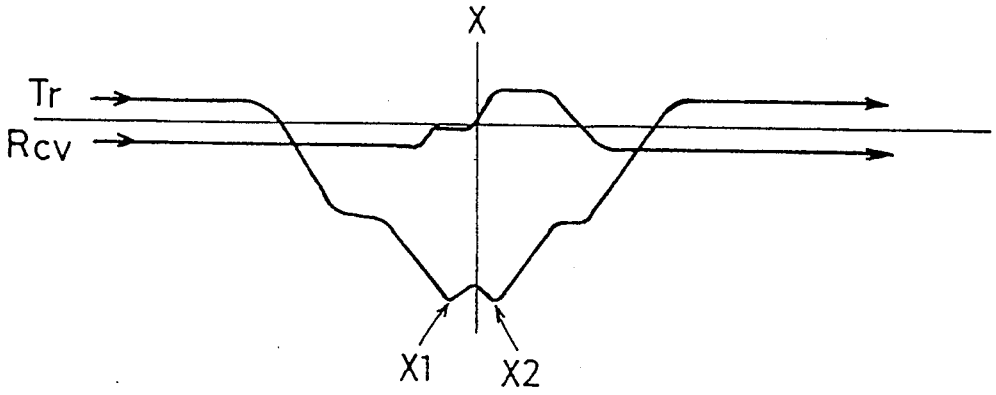
PRIOR ART Fig.1
FIG. 1 is explanatory of loci generated by knitting needles when transferring loops in a conventional flat knitting machine incorporating latch needles.
Figure 2:
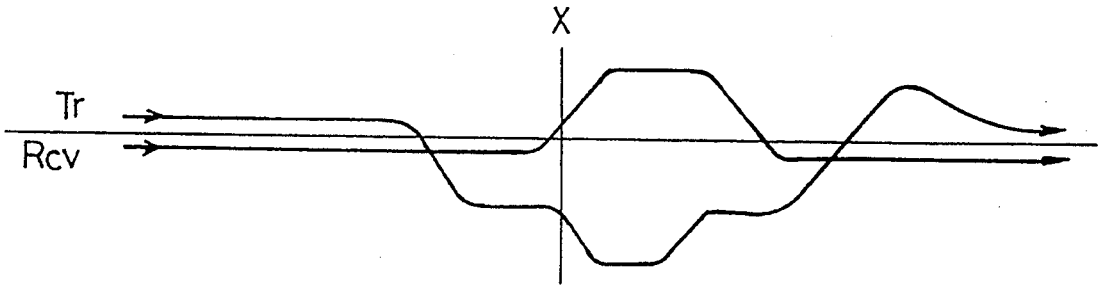
PRIOR ART Fig.2
FIG. 2 is explanatory of loci generated by knitting in a conventional flat knitting machine incorporating compound needles.
Figure 3:
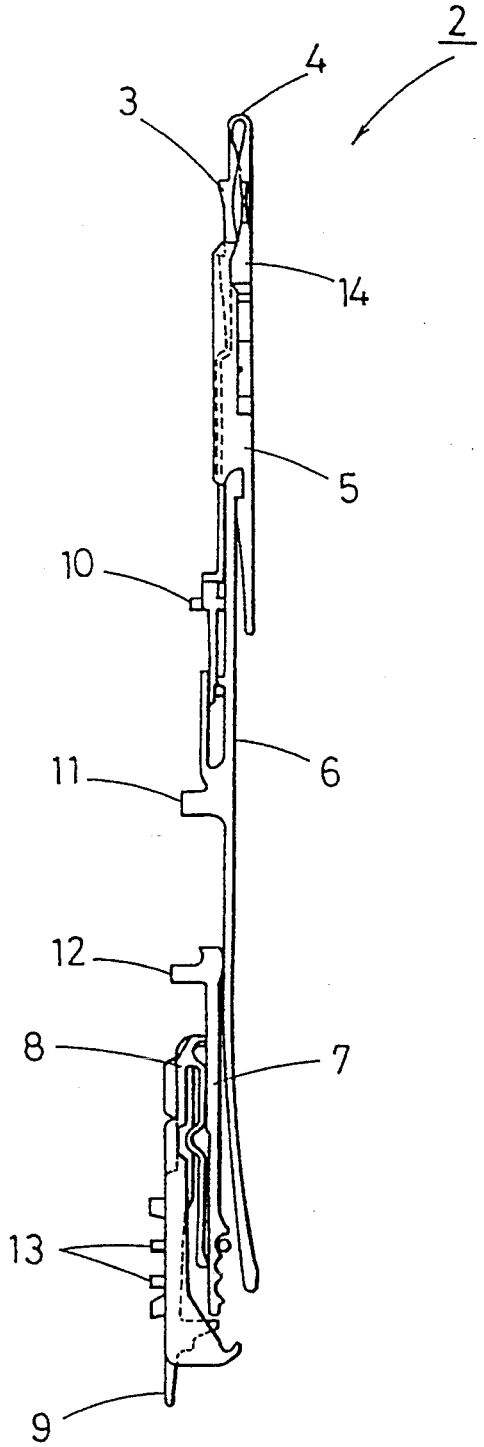
FIG. 3 is a lateral view of a compound needle.
Figure 5:
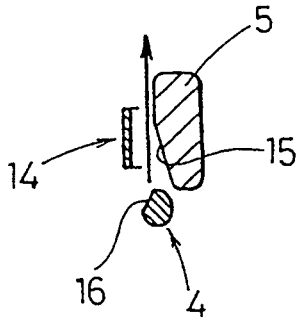
FIG. 5 is a partial sectional view of a hook of a knitting needle on the way of transferring a loop using the apparatus according to the first embodiment of the invention.

More particularly, each of these knitting needles 2 is substantially a compound needle incorporating a slider 3. As shown in FIG. 3, each compound needle 2 comprises the following; a knitting needle 5 provided with a hook 4 at the tip, a jack 6 connected to the rear end of the knitting needle 5, a select jack 7, a select spring 8, and a selector 9, which are sequentially disposed to the upper rear domain of the jack 6. A plurality of butts 10 through 13 respectively projecting themselves from the slider 3, jack 6, select jack 7, and the selector 9, are individually movable back and forth by a group of cams provided for the carriage 1 in correspondence with those butts 10 through 13. A loop expanding member 14 is installed on a lateral surface of each knitting needle 5 in order to expandably open a loop engaged with each compound needle 2. The loop expanding member 14 is formed by folding a metallic sheet into a square groove shape. An end of each loop expanding member 14 is secured to a lateral surface of each knitting needle 5. A lateral surface of each knitting needle 5 close to the hook 4 of each loop expanding member 14 consists of inclined surface 15, FIG. 5. Likewise, as shown in FIG. 5, the tip end of the hook 4 of each compound needle 2 interfering with the loop expanding member 14 is also provided with inclined surface 16 when laterally viewed.

A pair of carriages 1 provided for a pair of needle beds disposed in the front and rear positions are interlinked with each other via a connecting rod (not shown) so that both carriages 1 can move themselves in association with each other.

Figure 4:
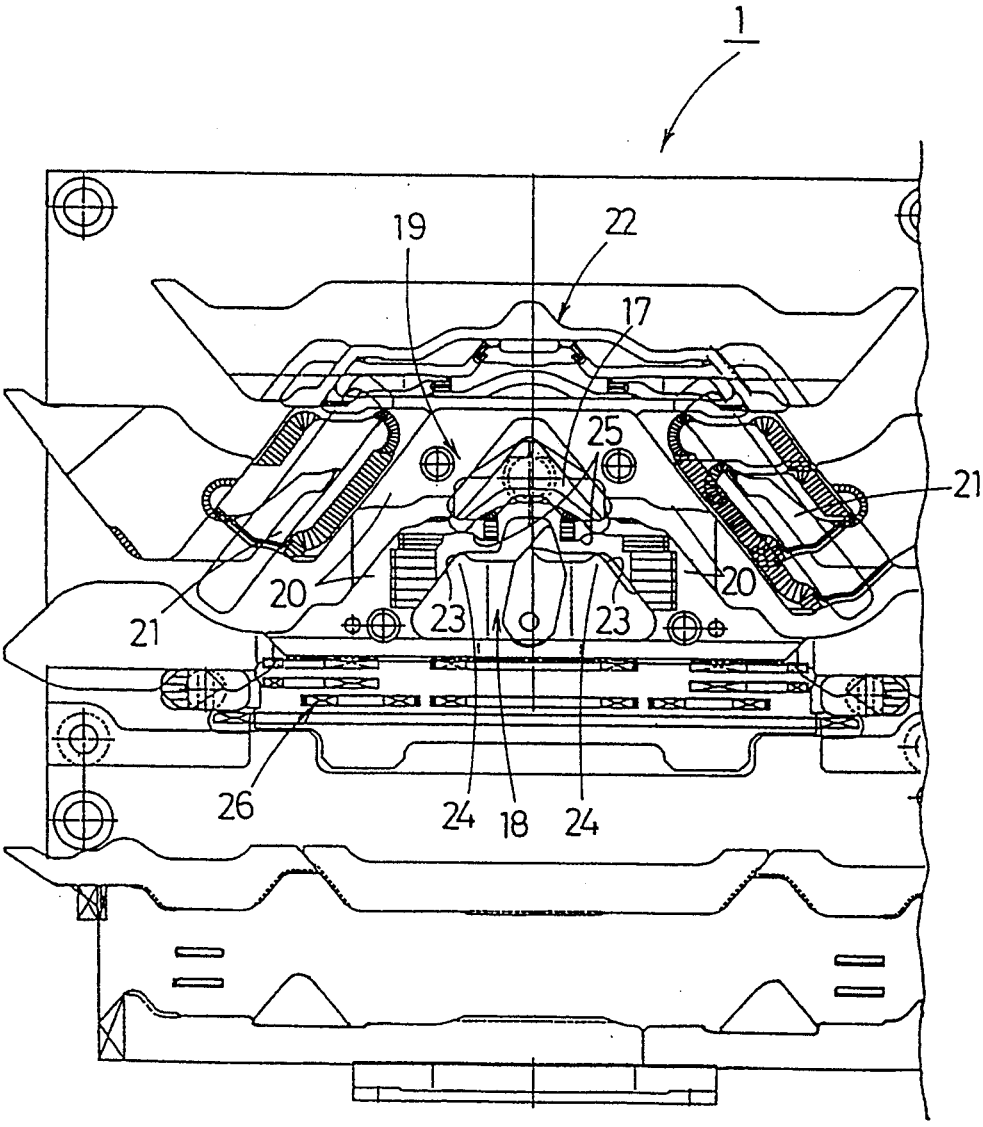
FIG. 4 is a detailed block diagram of a cam group of a carriage provided for the apparatus according to the first embodiment of the invention.

As shown in FIG. 4, a transfer raising cam 17 and a transfer receiving cam 18 having a trapezoidal shape are respectively secured to the center of each carriage 1. A pair of needle raising cams 20 are disposed above and alongside of the transfer raising cam 17. A pair of stitch cams 21 are respectively disposed alongside of a pair of needle raising cams 20. In addition, a slider guide cam 22 is disposed above those needle raising cams 20.

A pair of cams 24 respectively making up surfaces 23 for forcing knitting needles forward are projectively formed on the upper edges of the trapezoidal transfer receiving cam 18. A pair of surfaces 25 for retracting knitting needles are formed on a needle raising cam 20 which respectively face those surfaces 23 for a forward movement. A transfer cam 19 is composed of the trapezoidal transfer receiving cam 18 and the needle raising cam 20.

Of those two surfaces 23 for forcing the knitting needles forward, one of the surfaces 23 functions ahead of the transfer cam 19, whereas of those two surfaces 25 for retracting the knitting needles, one of the surfaces 25 for retracting the knitting needles function behind of the transfer cam 19.

The reference numeral 26 shown in FIG. 4 designates a pressing member which is disposed below the trapezoidal transfer receiving cam 18, where the pressing member 26 works on a butt 12 of the select jack 7.

Next, functional operation of the flat knitting machine featuring the above structure embodied by the invention is described below in reference to such a case when transferring a loop engaged with a delivery-side knitting needle **2*a* of a rear-side needle bed to a front-side receiver knitting needle 2*b* shown in FIGS. 7 through 12** for example.

Figure 6:
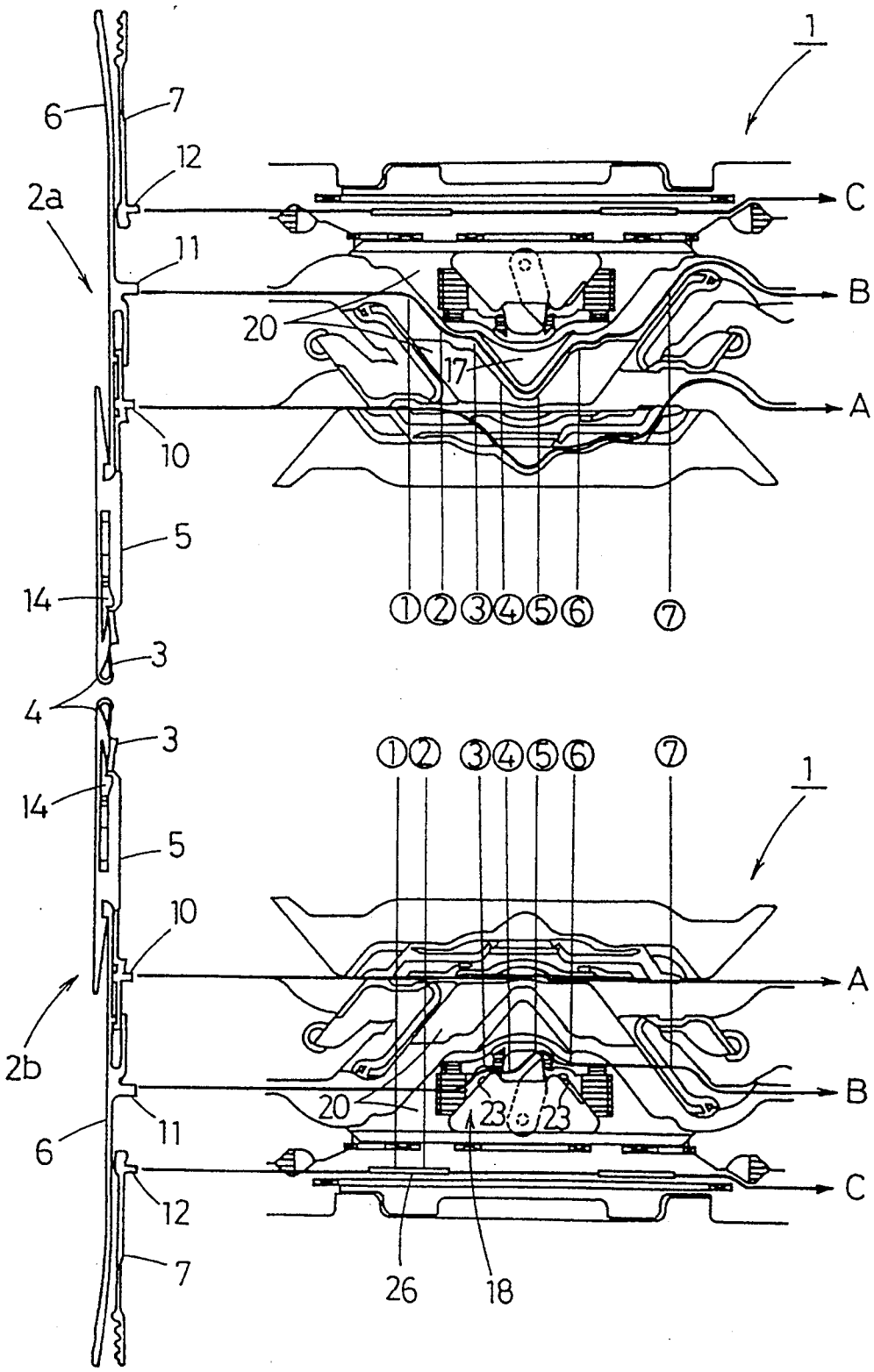
FIG. 6 is explanatory of loci of knitting needles in the course of passing through a cam group of a carriage of the apparatus according to the first embodiment of the invention.

Assume that a carriage 1 runs to the left over a needle bed. In this case, as shown in FIG. 6, those butts 10 through 12 corresponding to a slider 3, a jack 6, and a select jack 7, respectively pass through a group of cams of the carriage 1 from the left to the right as per those arrowed lines A, B, and C.

When the rear-side knitting needle **2*a* arrives at position (1) of the carriage 1, due to the function of a needle raising cam 20, the butt 11 corresponding to the jack 6 is pushed upward to cause the rear-side knitting needle 2*a* behind the butt 11 to ascend itself. In this case, the butt 10 of the slider 3 is left behind, and then, the slider 3 gradually retreats itself by way of relative movement. This in turn permits a hook 4 to open itself. When this condition is present, the butt 12 corresponding to the select jack 7 is sunk by a pressing member 26, and yet, those butts 10 and 11 of the slider 3 and the jack 6 are respectively held in the inoperative positions, and therefore, the front-side knitting needle 2*b* can jump itself without being disturbed by the needle raising cam 20**.

Figure 7:
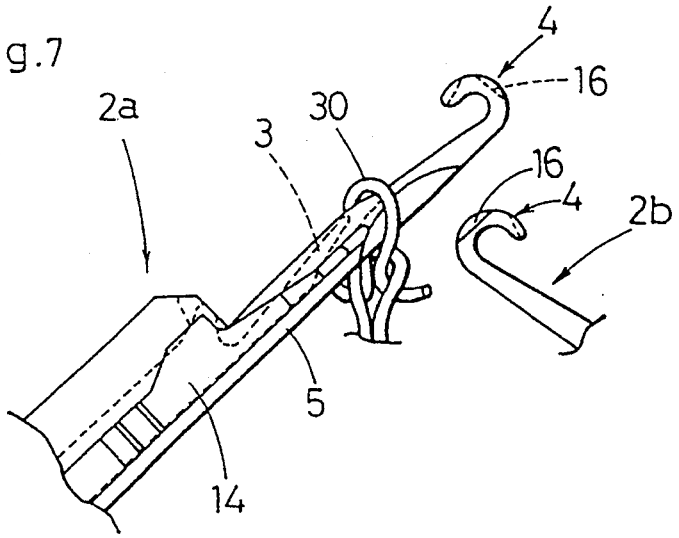
FIG. 7 is a lateral view of a delivery-side knitting needle and a receiving-side knitting needle in the course of transferring a loop according to the method of the first embodiment of the invention.

In the same way, when the rear-side knitting needle **2*a* arrives at position (2) of the carriage 1, the butt 11 of the jack 6 of the rear-side knitting needle 2*a* is pushed upward by the needle raising cam 20, and likewise, the butt 10 of the slider 3 is gradually pushed upward by the transfer raising cam 17. In consequence, as shown in FIG. 7, the hook 4 of the rear-side knitting needle 2*a* fully opens itself in such a state in which the slider 3** is held at the retreated position.

Next, when the rear-side knitting needle **2*a* arrives at position (3) of the carriage 1, the slider 3 and the jack 6 of the rear-side knitting needle 2*a* are respectively lifted by the transfer raising cam 17**.

Figure 8:
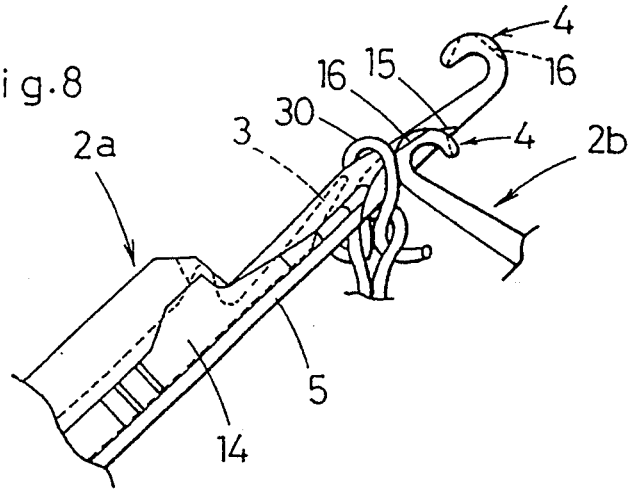
FIG. 8 is a lateral view of a delivery-side knitting needle and a receiving-side knitting needle in the course of transferring a loop according to the method of the first embodiment of the invention.

Simultaneously, as shown in FIG. 8, the front-side knitting needle **2*b* is lifted to a position at which the top end of the hook 4 is superposed with an inclined surface 15 on the lateral surface of the rear-side knitting needle 2*a* by means of one of (left-side) the forwarding cam surfaces 23 formed on both ends of the top side of the transfer receiving cam 18. When the front-side knitting needle 2*b* ascends, the hook 4 of this needle 2*b* receives a loop 30 which is apt to ascend itself in association with the forward movement of the rear-side knitting needle 2*a***.

Figure 9:
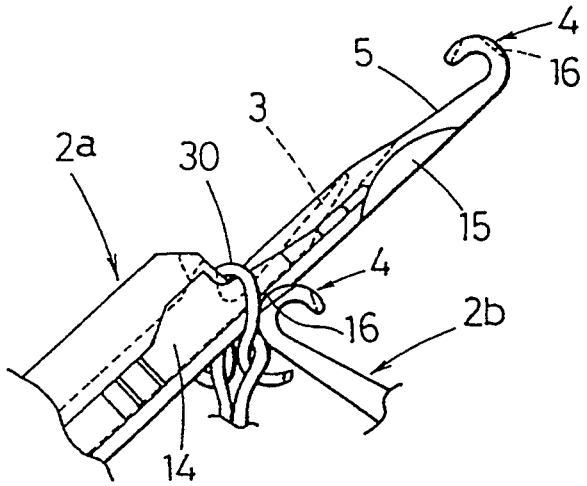
FIG. 9 is a lateral view of a delivery-side knitting needle and a receiving-side knitting needle in the course of transferring a loop according to the method of the first embodiment of the invention.

Next, the rear-side knitting needle **2*a* arrives at position (4) of the carriage 1. In the meanwhile, the front-side knitting needle 2*b* descends itself via a retreating cam surface 25. This in turn prevents the loop expanding member 14 from being damaged otherwise caused by unwanted contact of the hook 4 of the front-side knitting needle 2*b* with the loop expanding member 14 provided for the rear-side knitting needle 2*a*. Simultaneously, as shown in FIG. 9, the loop 30 is expanded to such a condition in which the loop 30 can encircle the external circumference of the loop expanding member 14** before being set to a normal position.

Figure 10:
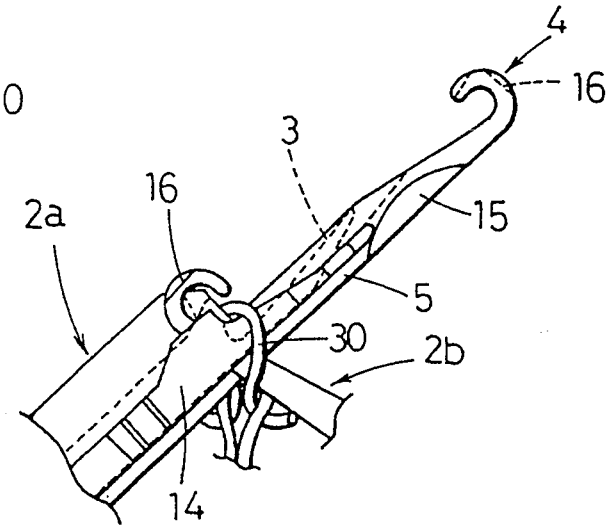
FIG. 10 is a lateral view of a delivery-side knitting needle and a receiving-side knitting needle in the course of transferring a loop according to the method of the first embodiment of the invention.

Next, when the rear-side knitting needle 2*a* arrives at position (5) of the carriage 1, as shown in FIG. 10, the front-side knitting needle 2*b* ascends itself, and as a result, the hook 4 of the front-side knitting needle 2*b* penetrates a clearance between the lateral surface of the rear-side knitting needle 2*a* and the loop expanding member 14 provided on this lateral surface.

Since the top end of the hook 4 of the front-side knitting needle 2*b* is provided with an inclined surface 16, the hook 4 is smoothly guided over the inclined surface 16 to prevent the loop expanding member 14 from incurring unwanted damage while the hook 4 moves on forward.

Next, when the rear-side knitting needle 2*a* arrives at position (6) of the carriage 1, it then starts to descend itself. As a result of this descending movement, the loop 30 is engaged with the hook 4 of the front-side knitting needle 2*b*.

Figure 11:
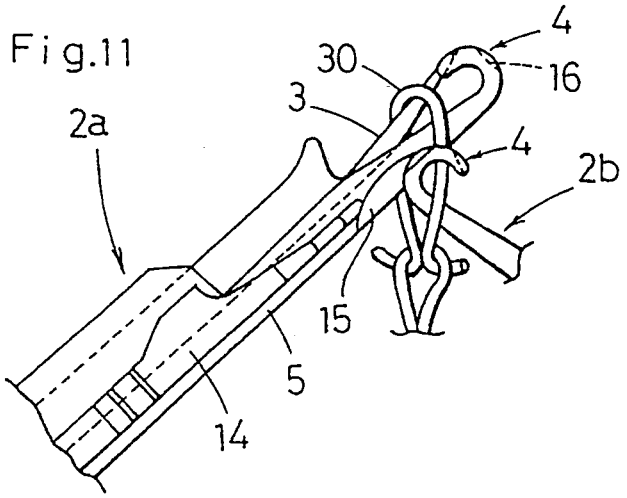
FIG. 11 is a lateral view of a delivery-side knitting needle and a receiving-side knitting needle in the course of transferring a loop according to the method of the first embodiment of the invention.
Figure 12:
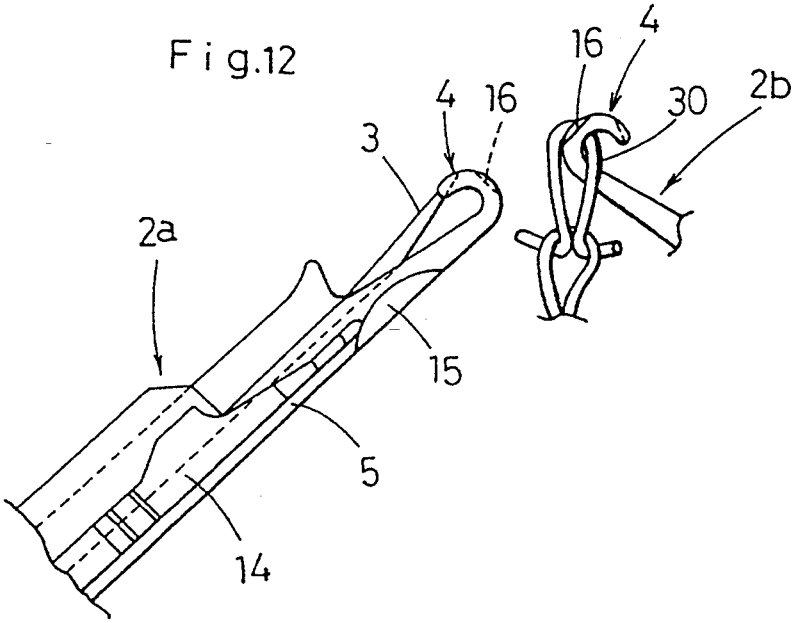
FIG. 12 is a lateral view of a delivery-side knitting needle and a receiving-side knitting needle in the course of transferring a loop according to the method of the first embodiment of the invention.
Figure 13:
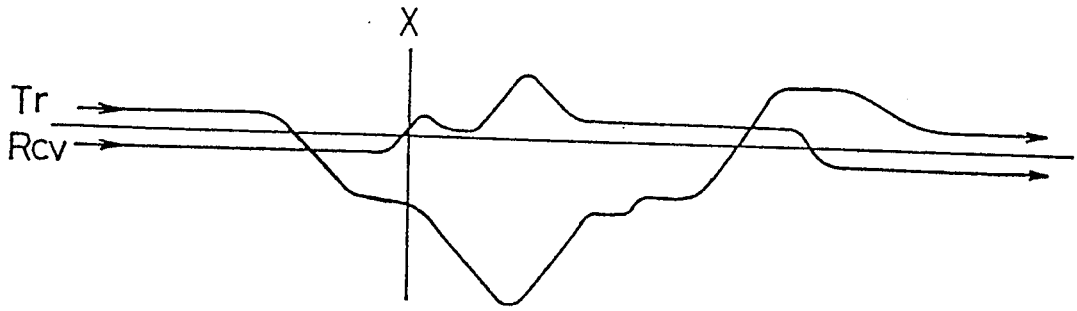
FIG. 13 is explanatory of the condition of the delivery-side and receiving-side knitting needles in the course of transferring a loop according to the method of the first embodiment of the invention.

Next, as shown in FIG. 11 while the rear-side knitting needle 2*a* shifts itself from position 6 to position 7, the slider 3 closes the hook 4. Next, the rear-side knitting needle 2*a* descends itself to clear the hook 4 closed by the loop 30. Finally, as shown in FIG. 12, the loop 30 thus far being engaged with the rear-side knitting needle 2*a* shifts itself to the front-side knitting needle 2*b*.

The Second Embodiment

Figure 14:
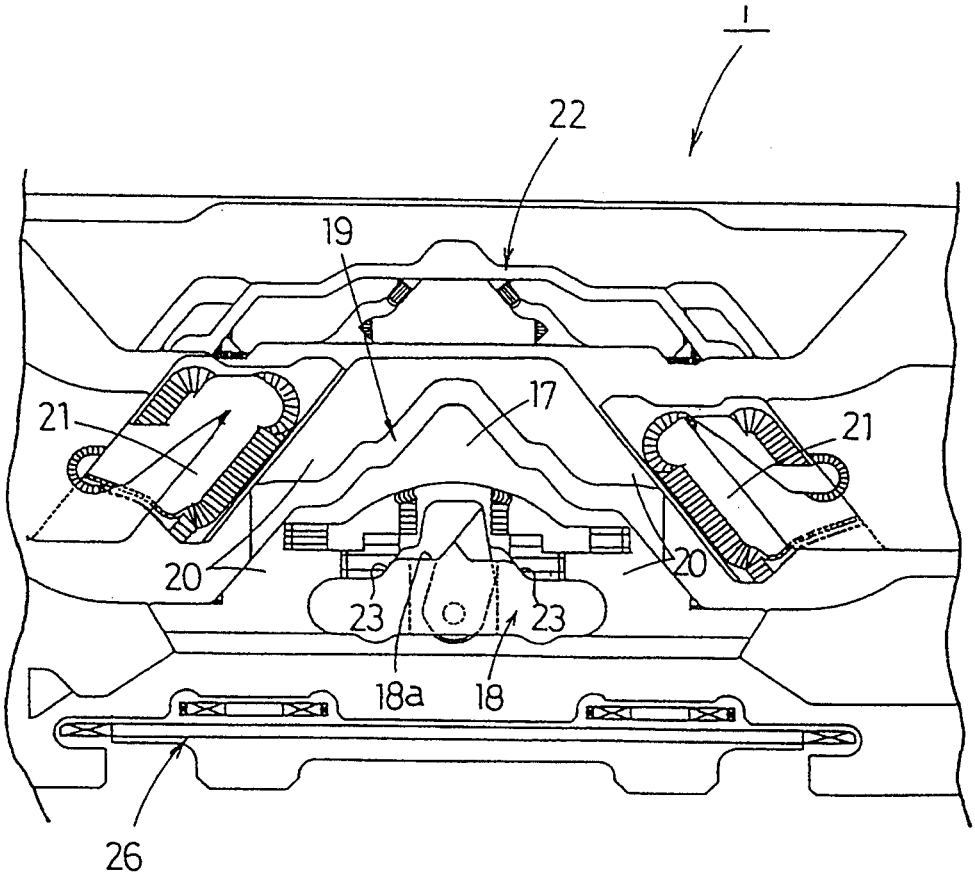
FIG. 14 is a detailed block diagram of a cam group provided for a carriage of the apparatus according to the second embodiment of the invention.

The second embodiment of the invention makes use of the identical flat knitting machine made available for implementing the first embodiment of the invention. Characteristically, transfer cam of the carriage 1 operating all the knitting needles of a pair of needle beds back and forth is of the structure shown in FIG. 14.

Concretely, height positions of a front-side knitting needle 2*b* lifted beyond the height of the top-edge 18*a* of a trapezoidal-form transfer receiving cam 18 via a jack butt 11 is arranged in order that a hook 4 can be superposed with an inclined surface 15 of a rear-side knitting needle 2*a* as laterally viewed, and yet, the above height position of the lifted front-side knitting needle 2*a* is free of interference with a loop expanding member 14 provided below the inclined surface 15. Both-end lateral surfaces of the top edge 18*a* of the transfer receiving cam 18 respectively make up forwarding cam surfaces 23.

All the remaining structural and functional details are exactly identical to those which are made available for the apparatus of the first embodiment of the invention.

The above description on the first and second embodiments of the invention has solely referred to the case of running the carriage 1 from the right to the left. Nevertheless, even when inverting the running direction of the carriage 1 to the right, according to the functional operation of the apparatus identical to the above case, the loop 30 engaged with the rear-side knitting needle 2*a* can be smoothly transferred to the front-side knitting needle 2*b* and vice versa.

Furthermore, the above description on the first and second embodiments of the invention has solely referred to the compound needles which are respectively furnished with a slider. However, it should be understood that the scope of the invention is also applicable to such a flat knitting machine furnished with latch needles.

What is claimed is:

1. A method of transferring loops from respective delivery-side knitting needles to confronting loop receiving-side knitting needles with a flat knitting machine having a pair of needle beds in front and rear positions each having a plurality of knitting needles aligned in parallel and a loop expanding member provided on a lateral surface of each delivery-side knitting needle and an opening between each expanding member and each delivery-side knitting needle comprising the steps of:

moving each of the confronting receiving-side knitting needles forward adjacent to each loop expanding member of the delivery-side knitting needles, pushing down loops held by the delivery-side knitting needles to the expanding members by using the receiving-side knitting needles, expandably opening the loops with the loop expanding members, forcing each receiving-side knitting needle to penetrate an opening between each expanding member and each delivery-side knitting needles, hooking the loops expandably opened by those loop expanding members with hooks of the receiving-side knitting needles, and transferring the loops of those delivery-side knitting needles to the confronting receiving-side knitting needles by retracting those delivery-side knitting needles with the hooks of those delivery-side knitting needles closed.

2. A method of transferring lops from respective delivery-side knitting needles to confronting loop receiving-side knitting needles with a flat knitting machine having a pair of needle beds in front and rear positions each having a plurality of knitting needles aligned in parallel and a loop expanding member provided on a lateral surface of each delivery-side knitting needle and an opening between each expanding member and each delivery-side knitting needle comprising the steps of:

moving each of the confronting receiving-side knitting needles forward, pushing down loops held by the delivery-side knitting needles to the expanding members by using the receiving-side knitting needles, retracting the receiving-side knitting needles to prevent an interference with the expanding members, forcing each receiving-side knitting needle to penetrate through an opening between each expanding member and each delivery-side knitting needle, hooking the looks expandably opened by those loop expanding members with hooks of receiving-side knitting needles, and transferring the loops of those delivery-side knitting needles to the confronting receiving-side knitting needles by retracting those delivery-side knitting needles with the hooks of those delivery-side knitting needles closed.

* * * * *